US005756920A

United States Patent [19]

Fleming

[11] Patent Number: 5,756,920

[45] Date of Patent: May 26, 1998

[54] SPECIAL EFFECT FLAME CANNON

[75] Inventor: Richard Neal Fleming, Apollo Beach, Fla.

[73] Assignee: Sigma Services, Inc., Plant City, Fla.

[21] Appl. No.: 647,090

[22] Filed: May 9, 1996

[51] Int. Cl.[6] ..... F41H 9/02; F23C 11/00; F23D 11/24

[52] U.S. Cl. ..... 89/1.1; 431/1; 431/2; 431/8; 431/91

[58] Field of Search ..... 89/1.11, 1.1, 8, 89/1.14; 431/91, 1, 2, 8

[56] References Cited

U.S. PATENT DOCUMENTS

| | | | |
|---|---|---|---|
| 1,220,103 | 3/1917 | Hall | 431/91 |
| 2,417,981 | 3/1947 | Graham | 431/91 |
| 2,851,094 | 9/1958 | Griffin | 431/91 |
| 2,971,573 | 2/1961 | Griffin et al. | 431/91 |
| 3,016,086 | 1/1962 | Smith | 431/91 |
| 3,880,569 | 4/1975 | Bannister et al. | 431/91 |
| 4,061,991 | 12/1977 | Hamid et al. | 431/91 |
| 4,247,283 | 1/1981 | Vidas | 431/253 |
| 4,395,227 | 7/1983 | Stivers | 431/142 |
| 5,055,050 | 10/1991 | Rogers et al. | 434/226 |
| 5,107,765 | 4/1992 | Schippers | 102/302 |
| 5,311,776 | 5/1994 | Morris | 73/306 |
| 5,587,283 | 12/1996 | Karinthi et al. | 431/10 |

FOREIGN PATENT DOCUMENTS

| | | | |
|---|---|---|---|
| 7524 | 3/1919 | United Kingdom | 431/91 |

OTHER PUBLICATIONS

The Condensed Chemical Dictionary, Van Nostrand Reinhold Co., pp. 732–733, 1971.

*Primary Examiner*—Michael J. Carone
*Assistant Examiner*—Christopher K. Montgomery
*Attorney, Agent, or Firm*—Michael A. Jaskolski

[57] ABSTRACT

A flame cannon for producing an explosion, the cannon including a tank, an effect valve, a nozzle and an ignitor, the tank coupled to a carbon dioxide source and a propane source, the tank and sources used to pressurize liquid propane therein. The nozzle forms a substantially linear and non-atomizing channel. When the effect valve between the tank and nozzle is opened, the pressurized liquid propane is forced through the nozzle and forms a liquid propane column thereabove which begins to disburse into the atmosphere wherein it is ignited to form a mushroom-shaped explosion.

33 Claims, 4 Drawing Sheets

SPECIAL EFFECT FLAME CANNON

FIELD OF THE INVENTION

The present invention relates to flame cannons used to create explosions and more particularly to a flame cannon including a non-atomizing nozzle and using a liquefied gas pressurized with a second propellant gas.

BACKGROUND OF THE INVENTION

Many theme parks employ a host of actors that reenact scenes from popular movies so that an audience can experience the movie making process first hand. Action scenes involving destruction and one or more simulated explosions are some of the most popular reenacted scenes. To produce realistic reenacted action scenes, theme parks are always searching for new and improved explosion producing methods and apparatus. To this end, special flame cannons have been designed to create large flame effects. Such flame cannon may use a liquefied gas such as propane forced through an atomizing nozzle.

Unfortunately, the flammable gas cannot be discharged a great distance before it disperses. This is particularly true where a flame cannon is used in an outside theater where wind conditions are variable. Even a moderate wind can disperse a large portion of the propane ruining the exploding effect or possibly creating a dangerous situation. Further, the effect of a large flame is quite unlike an explosion.

Therefore, it would be advantageous to have an improved flame cannon that could generate a large and controlled ball shaped explosion and which is relatively independent of wind conditions.

SUMMARY OF THE INVENTION

The present invention includes a special effects flame cannon that can create either a large or a small explosion and operates effectively even in windy outdoor environments. The cannon includes a fuel tank, a liquefied gas source coupled to the tank for providing a liquefied gas that liquefies at a liquefying pressure that is greater than ambient pressure, and a propellant gas source coupled to the tank for providing a propellant gas, the propellant gas remaining gaseous within a propellant pressure range above the liquefying pressure level. The cannon also includes an effect valve coupled to the tank, a nozzle coupled to the effect valve having a distal end, and, an ignitor at the distal end.

Prior to creating an explosion, the liquefied gas is pumped into the tank under a pressure that is greater than the liquefying pressure until a desired liquid level is reached. Then, the propellant gas is pumped into the tank until a desired tank pressure is reached, the desired tank pressure within the propellant pressure range. The ignitor is then ignited which will provide an ignition spark or flame adjacent the nozzle. Next, the effect valve is opened.

When the effect valve is opened, the tank pressure forces the liquefied gas through the effect valve and out a distal end of the nozzle. Preferably the nozzle is non-atomizing so that the liquefied gas retains its shape as a liquid column above the nozzle.

One object of the invention is to provide a flame cannon that can create an explosion having a large ball-shaped appearance. The tank, gas source and liquefied gas source can be used to provide a desired tank pressure that, when the effect valve is opened, propels the liquefied gas high (e.g. forty feet) into the air. Importantly, a liquid mass can be propelled further into the air and retain its compact form better than a vapor cloud. Therefore, unlike prior cannons that produce columnar flames, the present cannon can propel liquefied gas high into the air to create a ball shaped explosion.

To maximize the height of the explosion, preferably the nozzle defines an elongated substantially linear fluid directing channel such that, when liquid passes through the channel, liquid turbulence is minimized and a liquefied gas column emerges from the nozzle. In this way, instead of spreading and dispersing as it emerges from the nozzle, the liquid shoots substantially directly upward above the nozzle.

Another object is to create a mushroom-shaped explosion. As a liquid column forms above the nozzle, the ambient pressure outside the tank and nozzle is less than the liquefying pressure so the edges of the column quickly vaporize. A short time after having emerged from the nozzle, liquid at the top of the column will have been released prior to liquid at the bottom and therefore vapor at the top of the column will have radiated outwardly further than vapor at the bottom. The shape of the column and vapor will be similar to that of an inverted cone or mushroom. When ignited, a resulting explosion resembles a mushroom.

Yet another object is to create a large explosion that is relatively unaffected by wind conditions. The liquid column can be formed substantially unimpaired by wind and can reach relatively high heights even in relatively windy environments.

Preferably the flammable gas is propane and the propellant gas is carbon dioxide. Propane liquefies above 25 psi at temperatures of interest and therefore is gaseous at ambient pressure. Carbon dioxide remains gaseous at relatively high pressures, is inert, and will not react or mix with propane during the short time the are together.

Another object is to provide a flame cannon that can generate explosions of various sizes and shapes. With the inventive cannon explosion, explosion characteristics can be varied by changing the liquid level within the tank, the tank pressure, the length of time during which the effect valve is open, and nozzle characteristics (i.e. diameter and length). For example, a large explosion is created by filling the tank with liquid fuel and increasing tank pressure to a maximum level prior to opening the effect valve. A small explosion may be created by reducing tank fuel, pressure and/or the period over which the valve is open.

The invention also includes a special effect method for creating a large ball of fire using the inventive cannon described above or some other suitable cannon. The method includes the steps of, with the effect valve closed, pumping the liquefied gas into the tank such that the pressure within the tank is approximately the liquefying pressure and the liquefied gas remains a liquid within the tank, the liquefied gas pumped into the tank until a desired liquid level is reached, pumping the propellant gas into the tank until a desired tank pressure is reached and providing an igniting spark or flame at the nozzle. Thereafter, the method includes the step of opening the effect valve.

The foregoing and other objects and advantages of the invention will be apparent from the following description. In the description, reference is made to the accompanying drawings which form a part hereof and in which there is shown, by way of illustration, a preferred embodiment of the invention. The preferred embodiment does not necessarily represent the full scope of the invention, however, and reference must be made therefore to the claims herein for interpreting the scope of the invention.

DESCRIPTION OF THE PREFERRED EMBODIMENT

Figure 1:
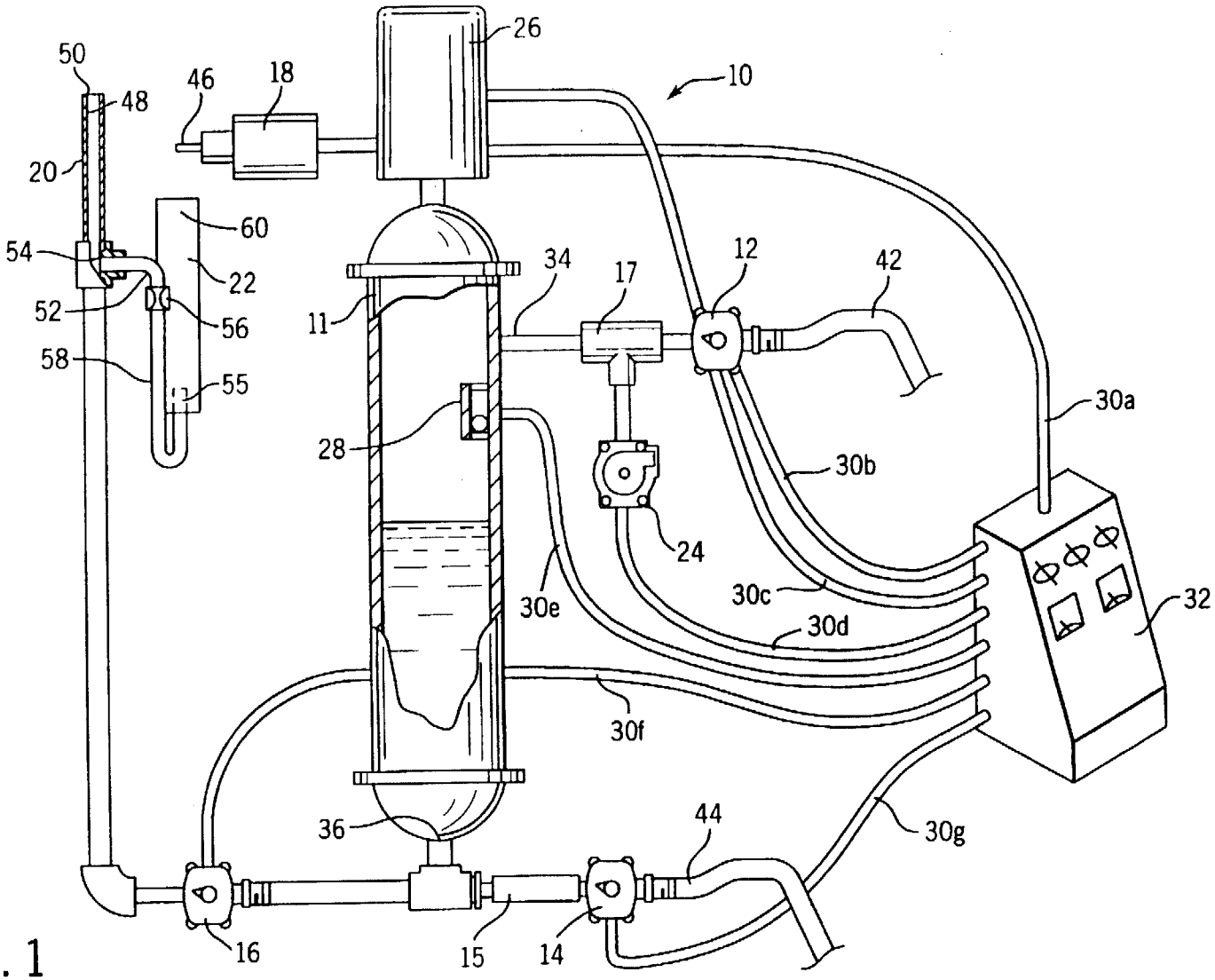
FIG. 1 is a schematic view, in partial cross-section, of a flame cannon according to the present invention.

Referring to FIG. 1, the inventive cannon 10 includes a tank 11, a gas valve 12, a liquid valve 14, an effect valve 16, an ignitor 18, an effect nozzle 20, a pilot nozzle 22, a bleed valve 24, control lines 30*a*–30*g*, a pressure sensor 26, a liquid level sensor 28, a control panel 32 and various other components connected as described below.

Figure 2C:
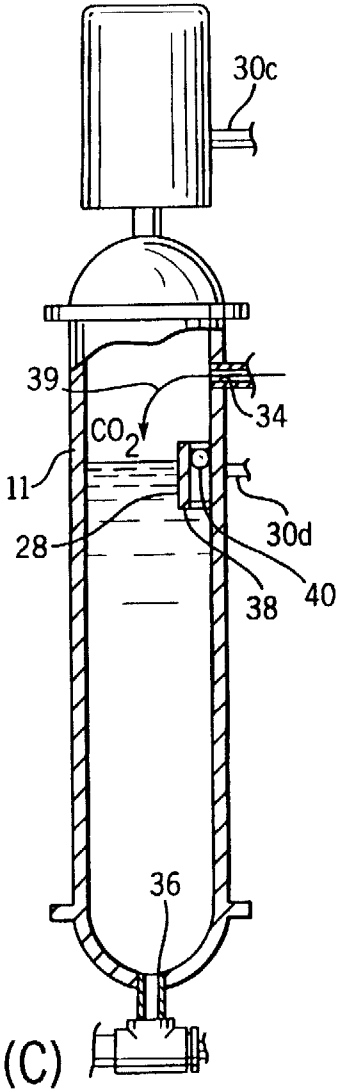
FIG. 2(C) is similar to the view shown in FIG. 2(A)
Figure 2B:
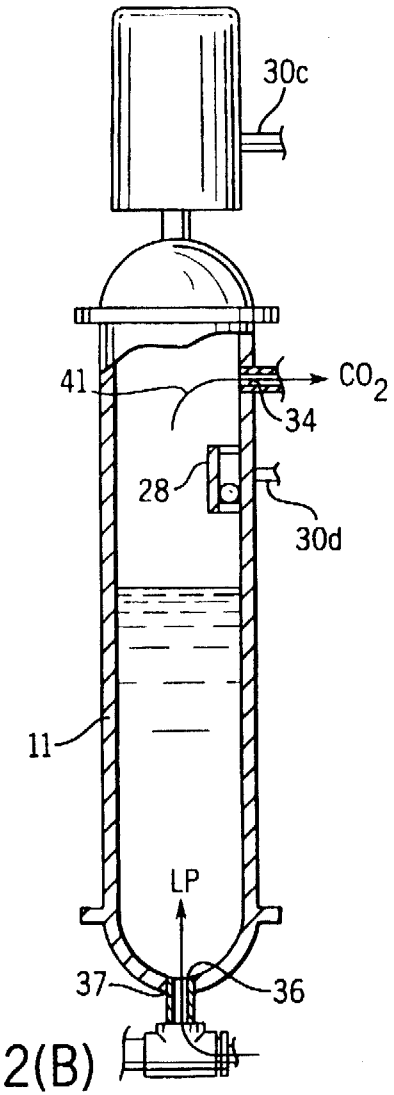
FIG. 2(B) is similar to the view shown in FIG. 2(A)
Figure 2A:
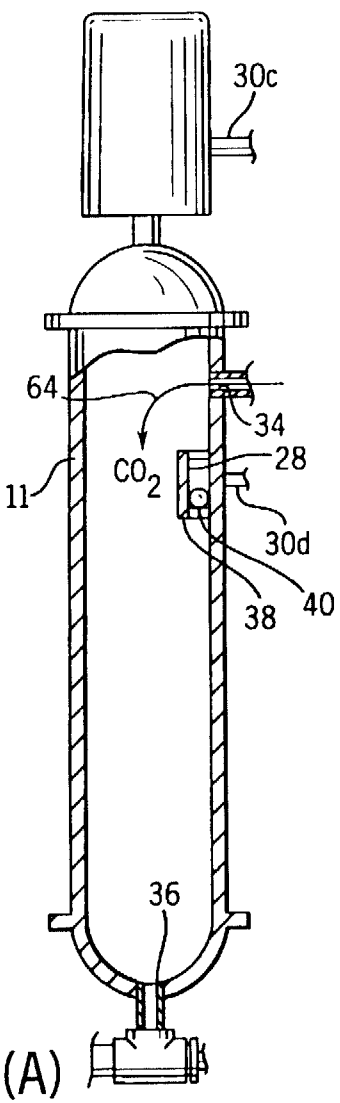
FIG. 2(A) is a partial cross-sectional view of the tank in FIG. 1.

Referring also to FIG. 2(A), the tank 11 includes an upper opening 34 near the top of the tank 11 and a lower opening 36 centrally located in a bottom tank wall. The liquid level sensor 28 includes a cage 38, a ball float 40 and trigger member (not shown). The liquid level sensor 28 is securely connected to an internal wall of the tank 11. When liquid inside the tank 11 rises to the level of the ball 40 inside cage 38, the ball 40 rises and trips the trigger. When the trigger is tripped, a signal is sent via control line 30*d* to the control panel 32 indicating that the liquid level in the tank has reached the level of the sensor 28. The pressure sensor 26 is located at the top of the tank and, in any manner well known in the art, can sense the pressure (i.e. psi) within the tank and provide a signal indicative of the pressure via line 30*b* to the control panel 32.

The gas valve 12 connects a propellant gas tank (not shown) via hose 42 to the upper opening 34. When the gas valve 12 is opened, propellant gas is pumped through hose 42 and valve 12 and into the tank 11 through the upper opening 34. The pumping action can be done either by a dedicated pump or a pressure differential between the tank 11 pressure and the propellant gas tank pressure. Similarly, the liquid valve 14 is coupled between the lower opening 36 and a hose 44 which is connected to a liquefied gas tank. A check valve 15 is coupled between the liquid valve 14 and opening 36. The check valve 15 allows fluid movement from valve 14 to the tank 11 but restricts movement in the opposite direction.

The effect valve 16 couples the liquid opening 36 to the nozzle 20. The bleed valve 24 is connected by a "T" joint 17 between the gas valve 12 and the upper opening 34. In FIG. 1, the valves 12, 14 16 and 24 are shown as electromagnetic and are controlled by electrical signals produced by the control panel 32 and provided on control lines 30*c*, 30*g*, 30*f* and 30*e* respectively.

The ignitor 18 preferably includes a high voltage (i.e. 6000 v) spark ignition system. This type of system is well known in the art and will not be explained in detail here. When turned on, the ignitor 18 provides an igniting spark at ignition point 46. The ignitor 18 is controlled by the control panel 32 via control line 30*a*.

The control panel 32 preferably includes a microprocessor for controlling the cannon 10, a plurality of buttons and switches allowing a user to open and close valves 12, 14 16 and 24 and turn on the ignitor 18, and, preferably, some type of feedback means (i.e. LEDs or meters) to indicate tank pressure, tank liquid level, and other system conditions. The microprocessor receives pressure and level signals from the pressure sensor 26 and the liquid level sensor 28 and provides data to an operator indicative of the data received. Using that information, an operator can determine when to open and close the various valves 12, 14, 16 and 24 and ignite the ignitor 18 according to an inventive protocol so as to generate explosions having desired characteristics.

Referring still to FIG. 1, the nozzle 20 is constructed so that turbulence within liquid passing therethrough and liquid emerging from a distal end 50 thereof is minimized. When liquid turbulence is minimized, liquid emerging from the distal end 50 is propelled primarily in a single direction. That is, liquid is forced along a line parallel to the nozzle 20 and forms a single substantially uniformly thick column above the distal end 50. To reduce liquid turbulence, the nozzle 20 forms an internal wall 48 that defines a substantially unobstructed smooth, linear and elongated channel. As liquid travels through the channel, turbulence is minimized. This is different than prior flame cannons wherein nozzles are formed to purposefully atomize fluid flow and to accelerate the vaporization of the liquid upon exit.

Referring still to FIG. 1, an elbow joint 52 is connected below the distal end 50 of the nozzle at a small nozzle aperture 54. The distal end of the elbow joint 52 points downwardly and is coupled to a "U" shaped diverting tube 58 by a needle valve (i.e. venturi) 56. The distal end of the diverting tube 58 points upwardly and forms an upwardly opening diverting nozzle 55. The pilot nozzle 22 is preferably a cylindrical tube having a lower end which encircles the diverting nozzle 55 and extends a few inches therebelow. An upper end 60 of the pilot nozzle 22 is upwardly open. The pilot nozzle upper end 60 is terminated below the distal end 50 of nozzle 20. The ignitor 18 should be positioned so that the ignition tip 46 is just above the upper end 60 of pilot nozzle 22 but a few inches below the distal end 50 of nozzle 20.

Importantly, in order for the present flame cannon 10 to work properly, the propellant gas and liquefied gas used must have certain characteristics. The liquefied gas must be highly flammable and must be a gas at and around earth's typical ambient pressure (i.e. ≈14.7 psi). In addition, the liquid must have a liquefying pressure that meets the above requirement but is still relatively low (i.e. ≦150 psi). The propellant gas, on the other hand, should be inert, should remain a gas within a propellant pressure range far above the liquefying pressure (i.e. >1000 psi), and should be chosen so that it will not react with the liquefied gas (i.e. will not dissolve therein). Moreover, each of the gas and liquid should be relatively inexpensive and easily attainable. To this end, the preferred propellant gas is carbon dioxide and the preferred liquefied gas is liquid propane. Hereinafter, the invention will be described as using carbon dioxide and liquid propane, although, the invention should not be so limited.

Figure 3:
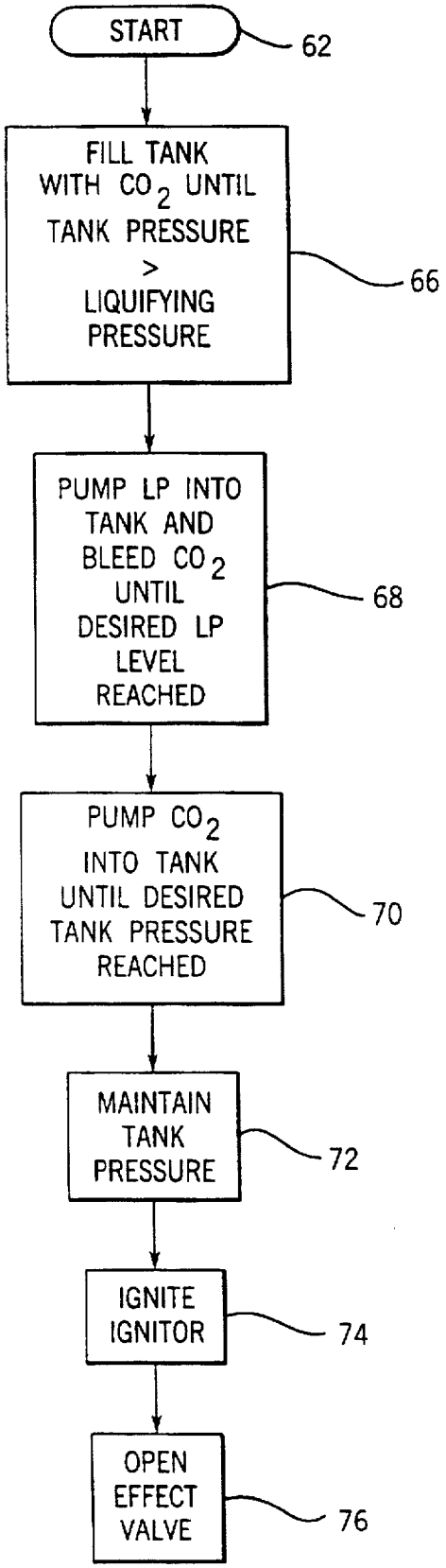
FIG. 3 is a flow chart of an inventive method.

Referring now to FIG. 3, with the components of the inventive flame cannon connected as described above, a method according to the present invention begins at start block 62. Referring also to FIGS. 1 and 2(A), initially, with a vacuum inside the tank 11 and all of the valves 12, 14, 16 and 24 closed, an operator uses the control panel 32 to open the gas valve 12. When valve 12 is opened, carbon dioxide is provided via hose 42 and valve 12 into the tank 11 increasing the pressure inside the tank. While pumping carbon dioxide into the tank 11, the operator observes the pressure inside the tank via pressure sensor 26, line 30*b* and a pressure gauge on the control panel 32. The tank pressure is increased to a level above the liquefying pressure of propane. Once the tank pressure exceeds the liquefying pressure, the operator closes the gas valve 12. These steps are illustrated in FIG. 3 by process block 66.

In the alternative, where the carbon dioxide source connected to hose 42 is known to be under a pressure greater than the liquefying pressure, the valve 12 can be opened until the tank 11 pressure is in equilibrium with the carbon dioxide source and then closed. In this case the operator does not have to monitor tank pressure.

Referring to FIGS. 1, 2(B) and 3, next, at process block 68, with all of the valves 12, 14, 16 and 24 closed, the operator opens the liquid valve 14 using control panel 32. Thereafter, the operator uses panel 32 to open the bleed valve 24 (e.g. a small orifice). With bleed valve 24 open, $CO_2$ inside the tank 11 begins to bleed out of the valve 24 and tank pressure falls. Once tank 11 pressure falls to the liquefying pressure LP passes through liquid valve 14, check valve 15 and lower opening 36 into the tank 11 and begins to fill up the tank 11. The bleed valve 24 maintains tank pressure at approximately the liquefying pressure of the LP but, at the same time, bleeds off some of the carbon dioxide inside the tank 11.

Referring also to FIG. 2(C), at some point the liquid level inside the tank 11 reaches the liquid level sensor 28 and the ball float 40 inside the cage 38 becomes buoyant, rises, and trips the trigger sending a signal via line 30*d* to the control panel 32 signaling to the operator that a desired tank liquid level has been reached. At this point, an operator uses control panel 32 to close both the liquid valve 24 and the bleed valve 14. In the alternative, the control panel microprocessor can be programmed to automatically close the liquid and bleed valves 14, 24 when the liquid level signal is received via line 30*d*.

Next, referring still to FIGS. 1, 2(C) and 3, at process block 70, with all of the valves 12, 14, 16 and 24 closed, the operator uses control panel 32 to again open gas valve 12 providing carbon dioxide to the tank 11 via upper opening 34. The operator monitors the pressure inside the tank via pressure sensor 26, line 30*b* and a gauge on the control panel 32 and allows the pressure inside the tank 11 to increase to a desire level high above the liquefying pressure but within a propellant pressure range wherein the carbon dioxide will not liquefy. Preferable tank pressure levels are between 150 and 1000 psi. The desired pressure level may be equal to the pressure in the carbon dioxide tank connected to hose 42. Where this is the case, the gas valve 12 is simply opened and equilibrium between the carbon dioxide tank and tank 11 is established shortly thereafter.

After the desire tank pressure is reached and during the following steps in the inventive method, the microprocessor maintains the desired tank pressure at process block 72. Where the desired pressure is the pressure in the propellant gas tank connected to hose 42, desired tank pressure is maintained by simply keeping the gas valve 12 open. At this point, the amount of liquid propane required to create an explosion of a desire size is inside the tank 11 under the pressure required to create a desired explosion.

Referring now to FIGS. 1 and 3, to create an explosion, at process block 74 the operator uses the control panel 32 to ignite the ignitor 18 via line 30*a*. When ignited, a continuous high voltage spark is generated at ignition point 46. For safety purposes, an optic eye (not shown) is provided adjacent the ignition point 46 to ensure that a spark arc appears at ignition point 46 prior to opening the effect valve 16 to initiate an explosion. Where the spark arc is not detected the microprocessor can stop cannon operation until the problem is corrected.

With the ignitor 18 ignited, at process block 76 the effect valve 16 is opened. When the effect valve is opened, the high pressure liquid propane inside the tank 28 is rapidly forced out of the tank, through valve 16 and into nozzle 20. While passing through the long smooth internal channel formed by the internal wall 48 of nozzle 20, liquid propane turbulence is reduced.

Figure 4A:
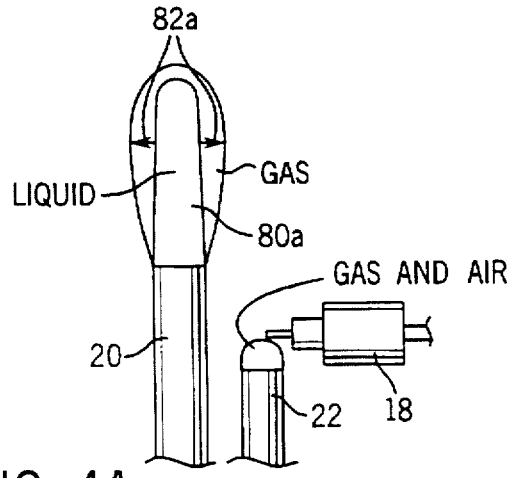
FIG. 4(A) is a schematic showing an initial comet of liquefied gas and gaseous gas according to the present invention.

Referring also to FIG. 4(A), because propane turbulence is minimal when the liquid emerges from the distal end 50 of the nozzle 20, the propane emerging from the distal end 50 forms a liquid column 80*a* above the distal end 50. When liquid passes through the nozzle 20, some of the liquid is drawn through aperture 54 by the needle valve and a divertion begins. Liquid passing through the needle valve 56 bends through diverting tube 58 and is forced through the diverting nozzle 55 which is designed to atomize the liquid propane forming a vapor within pilot nozzle 22. Once propane emerges from the diverting nozzle 55, it emanates from upper end 60 of the pilot nozzle 22 adjacent the ignition point 46. When the ignitor is ignited and vaporized propane emanates from the upper end 60, the propane is lit and a pilot flame results.

Because the liquefying pressure of propane is less than the ambient pressure, when propane is released from distal end 50, it quickly turns from liquid to gas. However, because of the high pressure inside the tank 11 and the speed with which propane emerges from the nozzle 20, the propane emerging from the nozzle 20 is under extreme pressure and maintains its liquid state for a short period after emergence. As the liquid emerges from the nozzle 20, liquid at the edges of the column 80*a* turns to gas as illustrated by arrows 82*a*. Expanding gas 82*a* adjacent the top portion of the column will have been out of the nozzle 20 for a relatively longer period of time and therefore will have expanded radially outwardly to a greater extent. Therefore, the resulting vapor cloud 82*a* about the column 80*a* will resemble a light bulb or mushroom in shape.

Referring to FIGS. 1 and 4(A), after the effect valve 16 is opened, the propane shoots through nozzle 20 and simultaneously through diverting tube 58 emanating from distal end 50 and diverting nozzle 54 at approximately the same time. However, a short period exists between the time when liquid propane initially emerges from end 50 and gaseous propane emerges from upper end 60 of pilot nozzle 22. During this time column 80*a* forms prior to ignition. Note that it is important that ignition point 46 be located below distal end 50 so that the column 80*a* and accompanying vapor cloud 82*d* does not immediately ignite which would reduce the height of the resulting explosion.

Figure 4B:
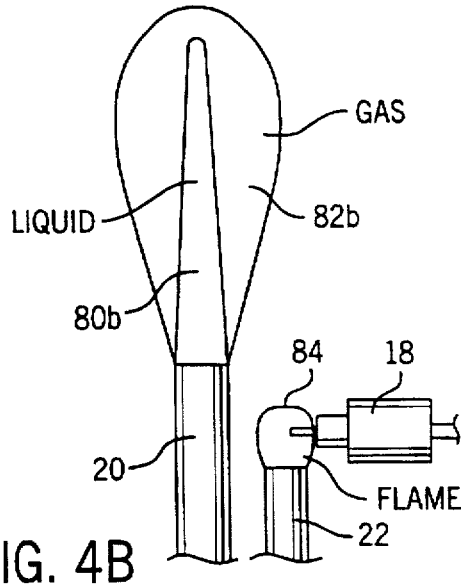
FIG. 4(B) is similar to FIG. 4(A) at a later stage.

Referring to FIGS. 1 and 4(B), as the propane vapor inside the pilot nozzle 22 rises, eventually, it emanates from the top end 60 of the nozzle 22 and comes into contact with the high voltage spark at ignition point 46. When the pilot cloud reaches the spark, the pilot cloud becomes ignited and forms a pilot flame 84. In the mean time, the liquefied gas column 80*b* and vapor cloud 82*b* therearound continues to grow and shoot upwardly and radially outwardly.

Figure 4C:
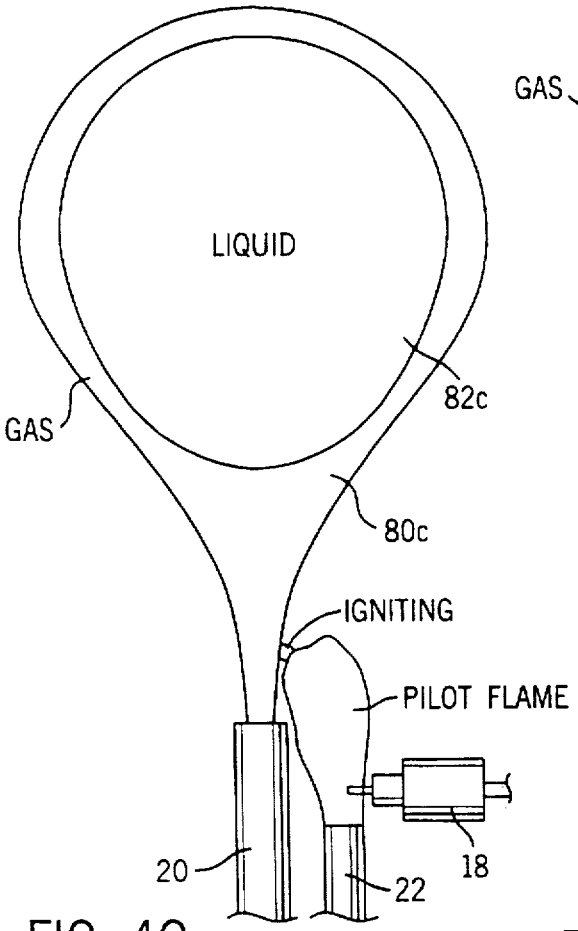
FIG. 4(C) is similar to FIG. 4(B); at yet a later stage.

Referring to FIG. 4(C), eventually, the liquid column forms a liquid ball 82*c* above the nozzle 50 and surrounded by a vapor cloud 80*c* which extends down to nozzle end 50. The ignited pilot flame 84 rises to a level where it contacts the lower end of the vapor cloud 82*c*. At this point, the vapor cloud 82*c* becomes ignited around the liquid column 80*c* and the main explosion begins.

Figure 4D:
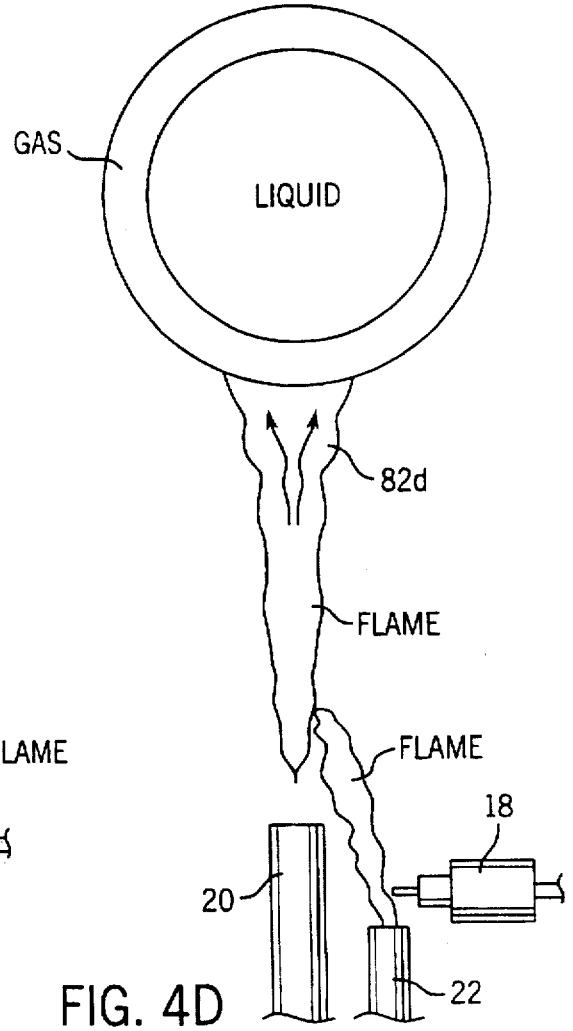
FIG. 4(D) is similar to FIG. 4(A) except that it shows the end of an explosion according to the present invention.

Referring to FIG. 4(D), eventually all of the liquid column 80*d* disperses and forms a gas cloud 82*d* which continually feeds the explosion resulting in a massive mushroom-shaped flame having a loud low frequency report high above the nozzle 20.

It should be understood that the methods and apparatuses described above are only examples and do not limit the scope of the invention, and that various modifications could be made by those skilled in the art that fall under the scope of the invention. For example, while the present invention is described as including a single tank 11, the invention could include two or more single shot tanks each of which could be use to provide an explosive blast. In addition, while the invention is described as requiring liquid propane and carbon dioxide, other gases and liquids could be used. The important characteristics of the liquid and gas being used are that the liquid must have a liquefying pressure which is greater than the ambient pressure and must be extremely flammable whereas the gas is preferably inert and remains gaseous at all tank pressures.

Moreover, the present invention could include different nozzles, a small diameter nozzle and a large diameter nozzle, the two different nozzles used to provide two differently shaped explosions. Furthermore, the present invention should not be limited by the type of ignitor used, the types of valves used, how the valves are powered to open and close, the type of pressure sensor, or the type of liquid level sensor. For example, while the invention was described as implemented using electromagnetic valves, the invention could clearly be practiced using air controlled or hydraulic controlled valves. In addition, the liquid level sensor may include a means for measuring any liquid level within the tank and the control panel may include a remote control device for operating all valves and the ignitor or a subset of the valves and the ignitor. In addition, while the method described includes many manual steps, the microprocessor could effectively carry out all of the method steps, opening and closing valves, and igniting the ignitor 18 as described above. Moreover, the step 66 of filling the tank 11 with $CO_2$ is preferably done at the same time that liquid propane is forced therefrom to create an explosion (i.e. the gas nozzle 12 remains open during step 76 to maintain high tank pressure and accomplish step 66). Furthermore, the present flame cannon can be used horizontally (i.e. shoot horizontally) or at any angle between vertical and horizontal and still provide the desired mushroom-shaped explosion without creating propane rain droplets. This cannot be done with other flame cannons on the market To apprise the public of the scope of this invention, I make the following claims.

I claim:

1. A special effect cannon for creating a large ball of fire in an area having an ambient pressure, the cannon comprising:

a fuel source for providing a pressurized liquefied gas the gas having a liquefying pressure greater than the ambient pressure the source including the liquefied gas and a propellant gas, the propellant gas remaining gaseous at the liquefying pressure of the liquefied gas;

an effect valve coupled to the fuel source;

a nozzle coupled to the effect valve at a proximal end for dispensing liquid from a distal end, the nozzle defining an elongated substantially linear fluid directing channel such that, when liquid passes through the channel, liquid turbulence is minimized and a liquefied gas stream emerges from the nozzle; and an ignitor for igniting the liquid at the distal end;

whereby, the velocity and pressure of the liquefied gas discharged from the nozzle is such that at least a portion of the liquefied gas remains a liquid and forms a column adjacent the nozzle prior to becoming a gas.

2. The cannon of claim 1 wherein the propellant gas is inflammable.

3. The cannon of claim 2 further including a liquefied gas valve coupling the tank to a liquefied gas source for providing the liquefied gas, the cannon further including a propellant gas valve coupling the tank to a propellant gas source for providing the propellant gas, the propellant gas remaining gaseous within a pressure range above the liquefying pressure.

4. The cannon of claim 3 wherein the liquefied gas is propane and the propellant gas is carbon dioxide.

5. The cannon of claim 3 further including a bleed valve positioned at the top of the tank for regulating pressure within the tank.

6. The cannon of claim 2 wherein a liquefied gas outlet is positioned at the bottom of the tank, the effect valve coupled to the outlet.

7. The cannon of claim 2 further including a sensor for identifying liquid height within the tank.

8. The cannon of claim 1 wherein the ignitor includes a venturi valve coupled to the nozzle for diverting liquefied gas from the nozzle, a diverting nozzle for releasing diverted liquid to the ambient forming a pilot stream, and a spark generator for igniting the pilot stream adjacent the liquid stream.

9. A special effect method for creating a large ball of fire in an area having an ambient pressure, the method to be used with a flame cannon including a fuel tank coupled to a nozzle by an effect valve, to a liquefied gas source for providing a liquefied gas that liquefies at a liquefying pressure greater than ambient pressure, and, to a propellant gas source for providing a propellant gas that remains gaseous within a propellant pressure range above the liquefying pressure, the method comprising the steps of:

(a) with the effect valve closed:

allowing the liquefied gas to flow into the tank at a liquid pressure until a desired liquid level is reached, the liquid pressure being a pressure at which the liquefied gas substantially remains a liquid;

allowing the propellant gas to flow into the tank until a desired tank pressure is reached wherein the tank pressure is within the propellant pressure range;

(b) opening the effect valve; and providing a flame at the nozzle;

whereby, the velocity and pressure of liquified gas discharged from the nozzle is such that at least a portion of the liquified gas remains a liquid and forms a column adjacent therefrom prior to becoming a gas.

10. The method of claim 9 wherein the tank also includes a pressure regulator for regulating pressure within the tank and the tank initially contains an initial gas, and the step of allowing the liquefied gas to flow includes the step of adjusting the pressure regulator to allow some of the initial gas to bleed out of the tank while the liquefied gas is flowing into the tank.

11. The method of claim 10 wherein the initial gas is carbon dioxide and, prior to allowing the liquefied gas to flow, the method includes the step of filling the tank with carbon dioxide.

12. The method of claim 11 wherein the step of filling the tank with carbon dioxide is contiguous with the step of opening the effect valve.

13. The method of claim 9 wherein the desired tank pressure is between 150 psi and 1000 psi.

14. The method of claim 9 wherein the liquefied gas is propane and the propelling gas is carbon dioxide.

15. The method of claim 9 wherein the nozzle defines an elongated substantially linear fluid directing channel such that, when liquid passes through the channel, liquid turbulence is minimized and a liquefied gas stream emerges from the nozzle, and the method further includes the step of, after opening the effect valve, passing the liquefied gas through the channel.

16. A special effect method for creating a large ball of fire in an area having an ambient pressure, the method to be used with a flame cannon including a fuel tank coupled to a nozzle by an effect valve, to a liquefied gas source for providing a liquefied gas that liquefies at a liquefying pressure treater than ambient pressure, and, to a propellant gas source for providing a propellant gas that remains gaseous within a propellant pressure range above the liquefying pressure, the method comprising the step of:

(a) with the effect valve closed:

allowing the liquefied gas to flow into the tank at a liquid pressure until a desired liquid level is reached, the liquid pressure being a pressure at which the liquefied gas substantially remains a liquid;

allowing the propellant gas to flow into the tank until a desired tank pressure is reached wherein the tank pressure is within the propellant pressure range;

(b) opening the effect valve; and providing a flame at the nozzle;

wherein the tank also includes a pressure regulator for regulating pressure within the tank and the tank initially contains an initial gas, and the step of allowing the liquefied gas to flow includes the step of adjusting the pressure regulator to allow some of the initial gas to bleed out of the tank while the liquefied gas is flowing into the tank.

17. The method of claim 16 wherein the initial gas is carbon dioxide and, prior to allowing the liquefied gas to flow, the method includes the step of filling the tank with carbon dioxide.

18. The method of claim 17 wherein the step of filling the tank with carbon dioxide is contiguous with the step of opening the effect valve.

19. The method of claim 9 wherein the tank is full of liquefied gas when the desired liquefied gas level is reached.

20. A special effect cannon for creating a large ball of fire in an area having an ambient pressure, the cannon comprising:

a fuel tank;

a liquefied gas source to the tank for providing a liquefied gas that liquefies at a liquefying pressure that is greater than the ambient pressure;

a propellant gas source coupled to the tank for providing a propellant gas, the propellant gas remaining gaseous within a pressure range above the liquefying pressure;

an effect valve coupled to the tank;

a nozzle coupled to the effect valve for dispensing a liquid stream from a distal end; and an ignitor positioned proximate the distal end;

whereby the velocity and pressure of the liquefied gas discharged from the nozzle is such that at least a portion of the liquefied gas remains a liquid and forms a column adjacent to the nozzle prior to becoming a gas.

21. The cannon of claim 20 wherein the liquified gas is propane and the propellant gas is carbon dioxide.

22. The cannon of claim 20 wherein the ignitor includes a venturi valve coupled to the nozzle for diverting liquefied gas from the nozzle, a diverting nozzle for releasing diverted liquid to the ambient forming a pilot stream, and a spark generator for igniting the pilot stream adjacent the liquid stream.

23. The cannon of claim 20 wherein a liquefied gas outlet is positioned at the bottom of the tank, the effect valve coupled to the outlet.

24. The cannon of claim 23 further including a sensor for identifying liquid height within the tank.

25. The cannon of claim 24 further including a bleed valve positioned at the top of the tank for regulating pressure within the tank.

26. The cannon of claim 20 wherein the nozzle defines an elongated substantially linear fluid directing channel such that, when liquid passes through the channel, liquid turbulence is minimized and a liquefied gas stream emerges from the nozzle.

27. A special effect cannon for creating a large ball of fire in an area having an ambient pressure, the cannon comprising:

a fuel source for providing a pressurized liquefied gas the gas having a liquefying pressure greater than the ambient pressure, the source including a fuel tank in which the liquefied gas and an inflammable propellant gas are contained;

an effect valve coupled to the fuel source;

a nozzle coupled to the effect valve at a proximal end for dispensing liquid from a distal end, the nozzle defining an elongated substantially linear fluid directing channel such that, when liquid passes through the channel, liquid turbulence is minimized and a liquefied gas stream emerges from the nozzle; and an ignitor for igniting the liquid at the distal end;

whereby, the velocity and pressure of the liquefied gas discharged from the nozzle is such that at least a portion of the liquefied gas remains a liquid and forms a column adjacent the nozzle prior to becoming a gas.

28. The cannon of claim 27 further including a liquefied gas valve coupling the tank to a liquefied gas source for providing the liquefied gas, the cannon further including a propellant gas valve coupling the tank to a propellant gas source for providing the propellant gas, the propellant gas remaining gaseous within a pressure range above the liquefying pressure.

29. The cannon of claim 28 wherein the liquefied gas is propane and the propellant gas is carbon dioxide.

30. The cannon of claim 27 wherein the ignitor includes a venturi valve could to the nozzle for diverting the liquefied gas from the nozzle, a diverting nozzle for releasing diverted liquid to the ambient forming a pilot stream, and a spark generator for igniting the pilot stream adjacent the liquid stream.

31. The cannon of claim 27 wherein a liquefied gas outlet is positioned at the bottom of the tank, the effect valve coupled to the outlet.

32. The cannon of claim 27 further including a sensor for identifying liquid height within the tank.

33. The cannon of claim 28 further including a bleed valve positioned at the top of the tank for regulating pressure within the tank.

* * * * *